US006546777B2

(12) United States Patent
Shore et al.

(10) Patent No.: US 6,546,777 B2
(45) Date of Patent: Apr. 15, 2003

(54) METHOD AND APPARATUS FOR REDUCING AND SIZING HOT ROLLED FERROUS PRODUCTS

(75) Inventors: T. Michael Shore, Princeton, MA (US); Pieter L. Keyzer, Worcester, MA (US); Bruce V. Kiefer, Holden, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/927,660

(22) Filed: Aug. 10, 2001

(65) Prior Publication Data

US 2002/0046590 A1 Apr. 25, 2002

Related U.S. Application Data

(60) Provisional application No. 60/231,108, filed on Sep. 8, 2000.

(51) Int. Cl.[7] ..... B21B 13/12
(52) U.S. Cl. ..... 72/235; 72/200
(58) Field of Search ..... 72/200, 201, 362, 72/364, 365.2, 366.2

(56) References Cited

U.S. PATENT DOCUMENTS

| | | | | | |
|---|---|---|---|---|---|
| 4,907,438 | A | * | 3/1990 | Sasaki et al. | 72/235 |
| 5,325,697 | A | * | 7/1994 | Shore et al. | 72/234 |
| 6,085,565 | A | * | 7/2000 | Suda et al. | 72/224 |
| 6,128,939 | A | * | 10/2000 | Fay et al. | 72/235 |
| 6,405,573 | B1 | * | 6/2002 | Takeda et al. | 72/235 |

FOREIGN PATENT DOCUMENTS

| | | |
|---|---|---|
| DE | 2126177 | 12/1972 |
| DE | 1652548 | 5/1979 |

OTHER PUBLICATIONS

Hein, O., et al., "Precision rolling system (PRS)—a new dimension in sizing systems", Aise Steel Technology, vol. 77, n. 9, Sep. 2000.

* cited by examiner

*Primary Examiner*—Allen Ostrager
*Assistant Examiner*—John S Goetz
(74) *Attorney, Agent, or Firm*—Samuels, Gauthier & Stevens, LLP

(57) ABSTRACT

A method of continuously rolling a ferrous workpiece into a finished round, comprising rolling the workpiece in successive first and second roll passes at an elevated temperature of between about 650 to 1000° C., the first and second roll passes each being defined by two work rolls and being dimensioned to effect a combined reduction in the cross sectional area of the workpiece of at least about 20–55%, with an accompanying effective strain pattern dominated by a concentration of maximum effective strain at a central region of the cross sectional area; and while the effective strain pattern remains dominated by a concentration of maximum effective strain at a central region of the cross section, continuing to roll the workpiece in at least third and fourth consecutive roll passes, each of the third and fourth roll passes being defined by at least three rolls and being sized to effect a combined reduction in the cross sectional area of the workpiece of not more than about 4–25 %.

5 Claims, 4 Drawing Sheets

METHOD AND APPARATUS FOR REDUCING AND SIZING HOT ROLLED FERROUS PRODUCTS

CROSS REFERENCE TO RELATED APPLICATION

This application claims priority from Provisional Patent Application Serial No. 60/231,108 filed Sep. 8, 2000.

BACKGROUND OF THE INVENTION

1. Field of the Invention

This invention relates to the continuous hot rolling of ferrous long products, including, inter alia, rounds, octagons, squares and the like.

2. Description of the Prior Art

As herein employed in the rolling of rounds, the term "sizing" means imparting a final deformation during the last stage of rolling to obtain a finished nominal product diameter within a specified standard tolerance which is typically about ±0.1 mm diameter tolerance and 0.1 mm ovality or better. Also, as herein employed, the term "free sizing" means making adjustments to the roll partings of sizing stands to produce finished product diameters which are slightly larger or slightly smaller than the nominal diameter designated for the roll grooves, but are diameters which are within an acceptable tolerance for the obtained diameter.

Various techniques have been developed for sizing and free sizing ferrous long products. For example, as disclosed in U.S. Pat. No. 4,907,438 issued Mar. 13, 1990 to Sasaki et al., it is known to roll round process sections through successive two roll sizing stands, with a round-round pass sequence, and with the roll passes configured to take relatively light reductions on the order of 8–15% per pass.

By feeding the sizing stands with different diameter rounds taken from different stands in the upstream intermediate or finishing sections of the mill, and by changing roll diameters and groove configurations, a range of products can be sized.

Some free sizing is also possible, albeit within a relatively narrow range, due to the limitations imposed by the spread which inevitably accompanies rolling in two roll passes.

A further drawback with the Sasaki et al. round-round pass sequence is the development in certain products of a duplex microstructure, where the grains throughout the cross section of the product vary in size by more than about 2 ASTM grain size numbers (measured in accordance with ASTM E112-84).

It is generally recognized that a variation of more than about 2 ASTM grain size numbers in the cross section of a product can cause rupturing and surface tearing when the product is subjected to subsequent bending and cold drawing operations. Such grain size variations also contribute to poor annealed properties, which in turn adversely affect cold deformation processes.

The development of duplex microstructures was subsequently recognized as stemming from the inability of the light reduction round sizing passes to achieve adequate deformation throughout the product cross section within a sufficiently short time. This problem was addressed by the technique described in U.S. Pat. No. 5,325,697 issued July 5, 1994 to Shore et al. Here, a two roll round-round light reduction sizing sequence is immediately preceded by a heavy reduction two roll oval-round pass sequence. The heavy reductions taken in the oval-round pass sequence produce a deformation pattern penetrating to the center of the product with high strains. Before the accompanying stresses are relieved through microstructural recrystallization and recovery, rolling continues in the immediately succeeding light reduction two roll passes.

In effect, therefore, the reductions taken in the four successive passes comprise one substantially continuous process, with a resulting strain pattern across the product cross section which avoids the development of a duplex microstructure.

Here again, however, the available range of free sizing rolling is limited due to the spread experienced when rolling in two roll passes.

It is also known to employ three and four roll passes in round-round sizing sequences. These afford a wider range of free size rolling because the products are more closely confined in the roll passes and thus do not experience the degree of spread encountered in two roll passes.

However, as compared to two roll passes, three and four roll passes are far less efficient in achieving sufficient penetration of deformation to the center of the product. Such penetration is required to obtain a uniform grain structure from center to surface of the product. This is particularly important for products which develop their properties from grain refinement.

There exists a need, therefore, for an improved method of hot rolling long products, which is capable of achieving sizing tolerances and substantially uniform center to surface grain structures, and which also has a broadened range of free sizing. It is to these ends that the present invention is directed.

SUMMARY OF THE INVENTION

In accordance with a preferred embodiment of the present invention, a round ferrous process section is initially rolled in first and second two roll passes at an elevated temperature of between about 650 to 1000° C. to effect a combined heavy reduction in cross sectional area of at least about 20–55%, with an accompanying effective strain pattern dominated by a concentration of maximum effective strain at a central region of the product's cross section. Prior to the occurrence of microstructural changes due to recrystallization and recovery and while the effective strain pattern remains dominated by a concentration of maximum effective strain at a central region of the product's cross section, the product is rolled in at least third and fourth roll passes, each being defined by at least three rolls, to effect a further combined relatively light reduction in product cross sectional area of not more than about 4–25%.

When rolling a round process section into a finished round product in the above manner, e.g., a rod or bar, the first roll pass produces an oval cross section and the second roll pass produces a round process cross section.

The third and fourth roll passes complete the shaping of the process round cross section into a finished round having no more than ±0.1 mm diameter tolerance and 0.1 mm ovality, or ¼ ASTM Rod or Bar tolerance, whichever is better. After cooling to a state of thermal equilibrium, the resulting product will have a grain size variation across its cross section of not more than about 2 ASTM grain size numbers.

These, and other features and advantages of the present invention will now be described in greater detail with reference to the accompanying drawings, wherein:

DETAILED DESCRIPTION OF PREFERRED EMBODIMENTS

Figure 1:
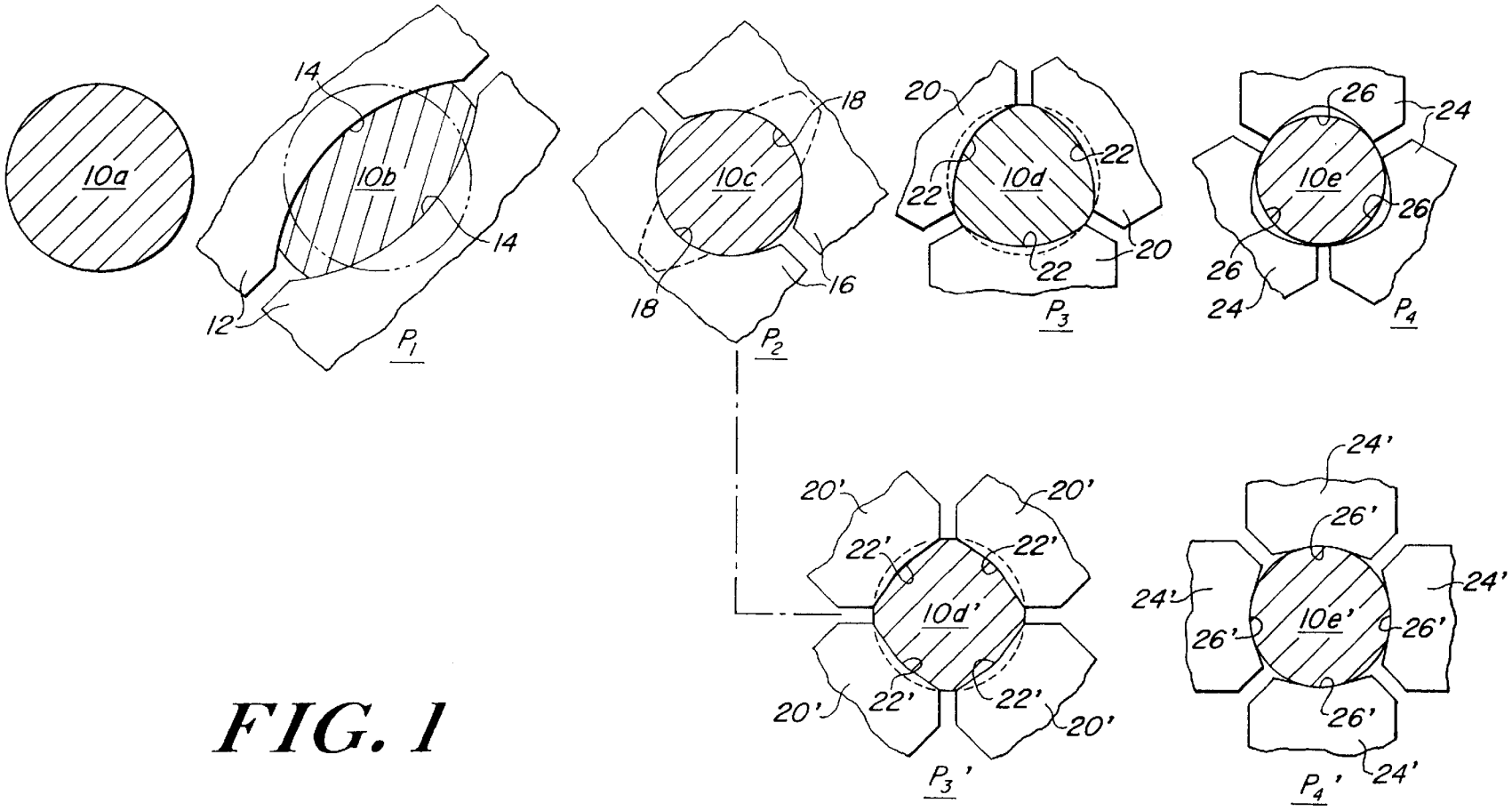
FIG. 1 is a diagrammatic illustration of two alternative pass sequences in accordance with the present invention.

Referring initially to FIG. 1, a pass sequence in accordance with the present invention includes four roll passes $P_1$–$P_4$ configured to roll a round process section 10*a* into a finished round 10*e*. Roll pass $P_1$ is defined by two work rolls 12 having grooves 14 configured to roll the round process section 10*a* into an oval 10*b*.

Roll pass $P_2$ is defined by two work rolls 16 having grooves 18 configured to roll the oval 10*b* into a process round 10*c*. Depending on the rolling schedule being employed, roll passes $P_1$, $P_2$ will be dimensioned to effect combined reductions of between about 20–55%, with from about 11 to 28% occurring in roll pass $P_1$, and with about 10 to 23% occurring in roll pass $P_2$.

Roll pass $P_3$ is defined by three work rolls 20 having grooves 22 configured to roll the process round 10*c* into another process round 10*d*. Roll pass $P_4$ is also defined by three work rolls 24 having grooves 26 configured to roll the process round 10*d* into the finished round 10*e*.

Again, depending on the rolling schedule being employed, roll passes $P_3$, $P_4$ will be sized to effect combined reductions of between about 3–25%, with from about 1.8 to 17% occurring in roll pass $P_3$, and with about 1.2 to 10% occurring in roll pass $P_4$.

With this pass sequence, for example, if the process section 10*a* has a diameter of 14.032 mm, and the finished round is to have a diameter of 10.0 mm, the progressive areas reductions in roll passes $P_1$–$P_4$ will be, respectively, 22%; 18%, 10%; 8%.

Typically, rolling will occur in roll passes $P_1$–$P_4$ at elevated temperatures of between about 650 to 1000° C.

Figure 2A:
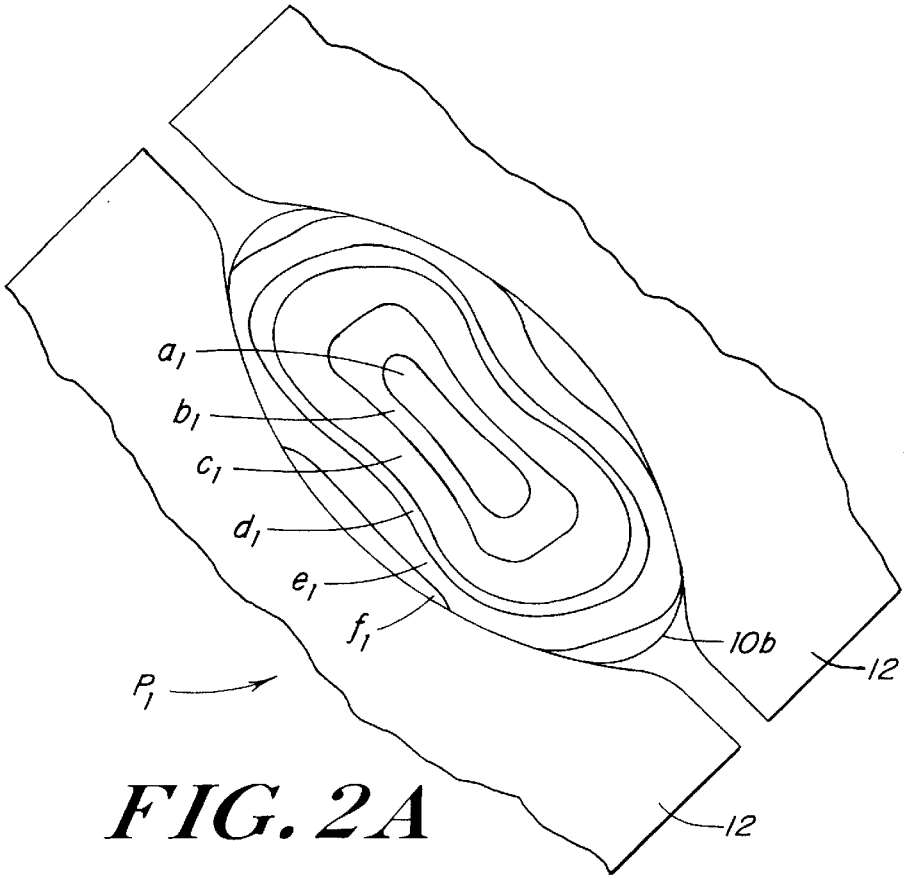
FIGS. 2A–2D are finite element based simulations of the levels of effective plastic strain resulting from deformation of the product in the successive roll passes $P_1$, $P_2$, $P_3$, $P_4$ depicted in FIG. 1.

FIGS. 2A–2D illustrate the effective strain patterns of the product as it emerges from the successive roll passes depicted in FIG. 1. As shown in FIG. 2A, the oval 10*b* emerging from the high reduction two roll pass $P_1$ has an effective strain pattern dominated by a concentration of maximum effective strain at a central region $a_1$. Progressing outwardly from central region $a_1$, are regions $b_1$, $c_1$, $d_1$ and $e_1$ having progressively lower effective strain levels, with the lowest effective strain level being at regions $f_1$, adjacent to the outer boundaries of the product cross sectional area.

Figure 2B:
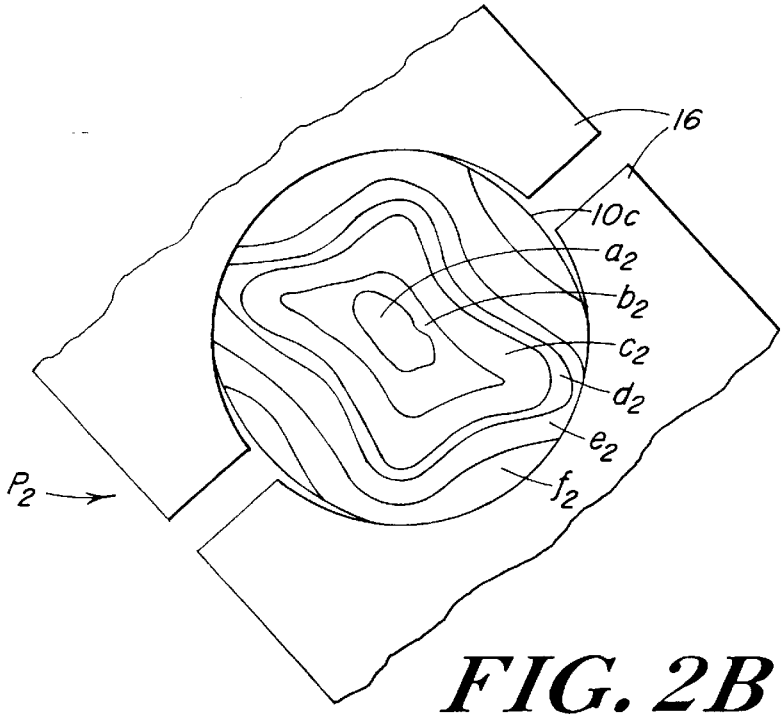

FIG. 2B shows that the process round 10*c* emerging from the second high reduction two roll pass $P_2$ retains an effective strain pattern dominated by a central region $a_2$ of maximum effective strain, with progressively lower effective strain levels in surrounding regions $b_2$–$f_2$.

Figure 2C:
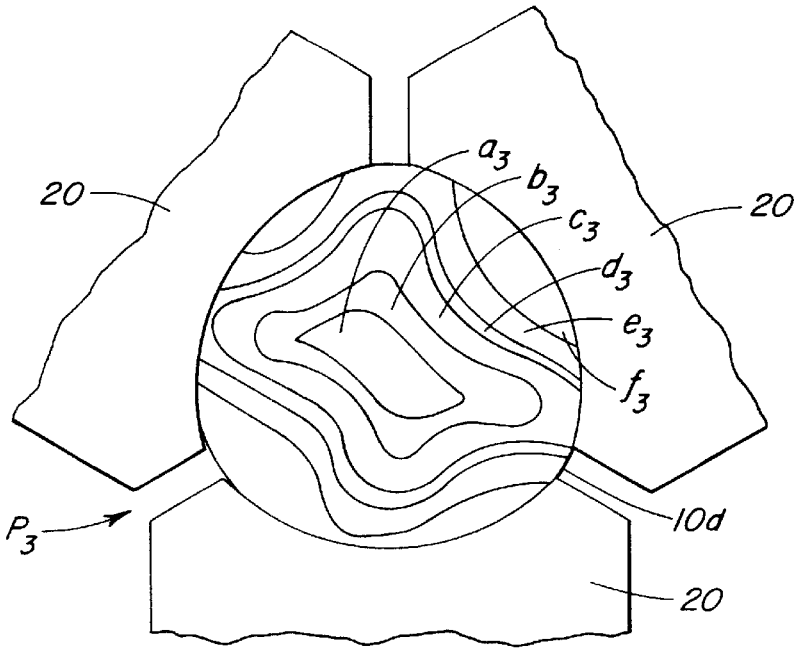

FIG. 2C shows the effective strain pattern in the process round 10*d* emerging from the three roll light reduction sizing pass P3. The maximum effective strain level is maintained in the central region $a_3$, which is again surrounded by regions $b_3$–$f_3$ of progressively lower effective strain levels.

Figure 2D:
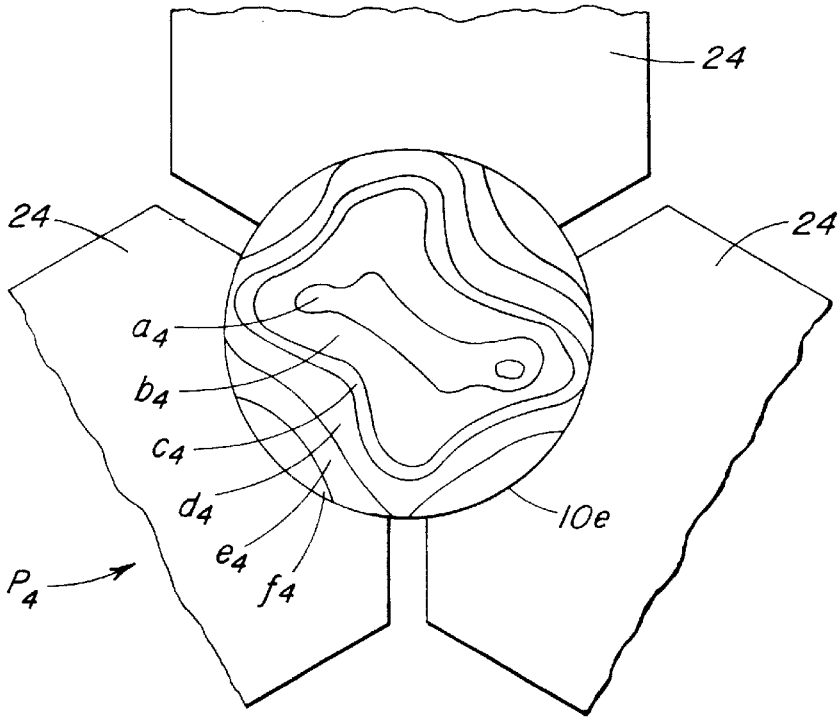

In the final light reduction three roll pass $P_4$, as shown in FIG. 2D, the effective strain pattern in the exiting round 10*e* continues to be dominated by maximum effective strain in region $a_4$, with progressively lower effective levels in surrounding regions $b_4$–$f_4$.

The smallest grain size will thus be located in region $a_4$, with progressively larger grains being located in the surrounding regions $b_4$–$f_4$. As the finished round 10*e* is then allowed to cool, the rate of cooling across its cross section will diminish from a maximum at the outermost regions $f_4$, where the grains are larger, to a minimum at the innermost region $a_4$, where the grains are smaller. As cooling takes place, the grains in each region will grow by an amount proportional to the time needed for each region to cool, thus reducing the difference in grain size between innermost and outermost regions, resulting in a variation in grain size across the cross section of the product of not more than about 2 ASTM grain size.

Returning to FIG. 1, the process round 10*c* emerging from roll pass $P_2$ may alternatively be sized in four roll passes $P_{3'}$ and $P_{4'}$. Roll pass $P_{3'}$ is defined by four work rolls 20' having grooves 22' configured to roll process round 10*c* into another process round 10*d*'. Roll pass $P_{4'}$ is also defined by four work rolls 24' having grooves 26' configured to roll the process round 10*d*' into a finished round 10*e*'.

Figure 3A:
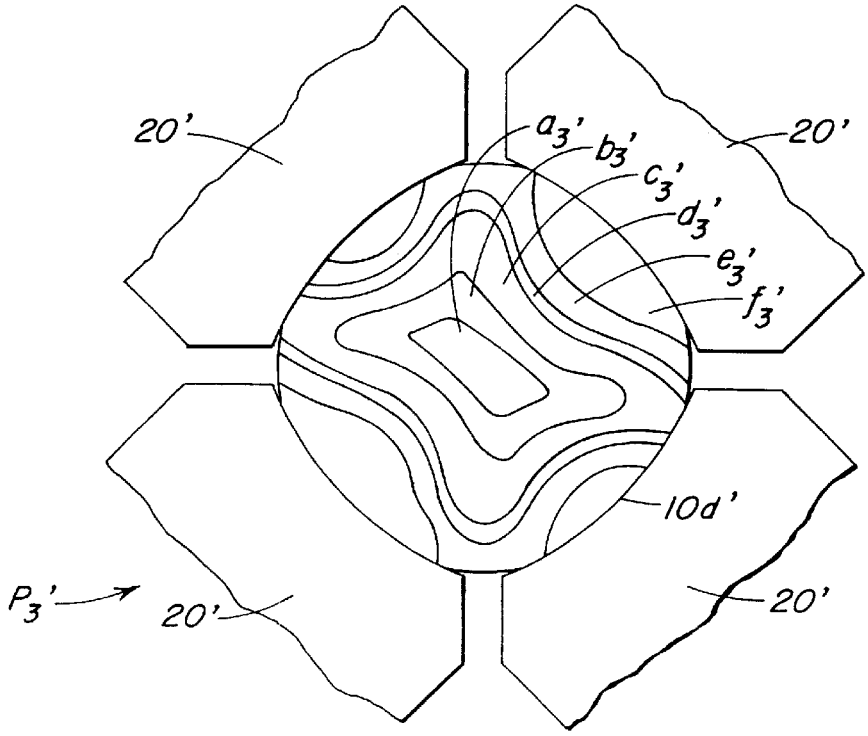
FIGS. 3A–3B are finite element based simulations of the levels of effective plastic strain resulting from deformation of the product in roll passes $P_3'$ and $P_4'$ after the product had been rolled initially in roll passes $P_1$, and $P_2$.

The effective strain patterns of the product as it emerges from roll passes $P_1$ and $P_2$ is as described previously and illustrated in FIGS. 2A and 2B. The effective strain patterns of the product as it emerges from roll passes $P_{3'}$ and $P_{4'}$ are depicted, respectively, in FIGS. 3A and 3B. It will be seen that here again, the process section 10*d*' has an effective strain pattern dominated by a maximum effective strain in region $a_{3'}$ surrounded by regions $b_{3'}$–$f_{3'}$ of progressively lower strain levels.

Figure 3B:
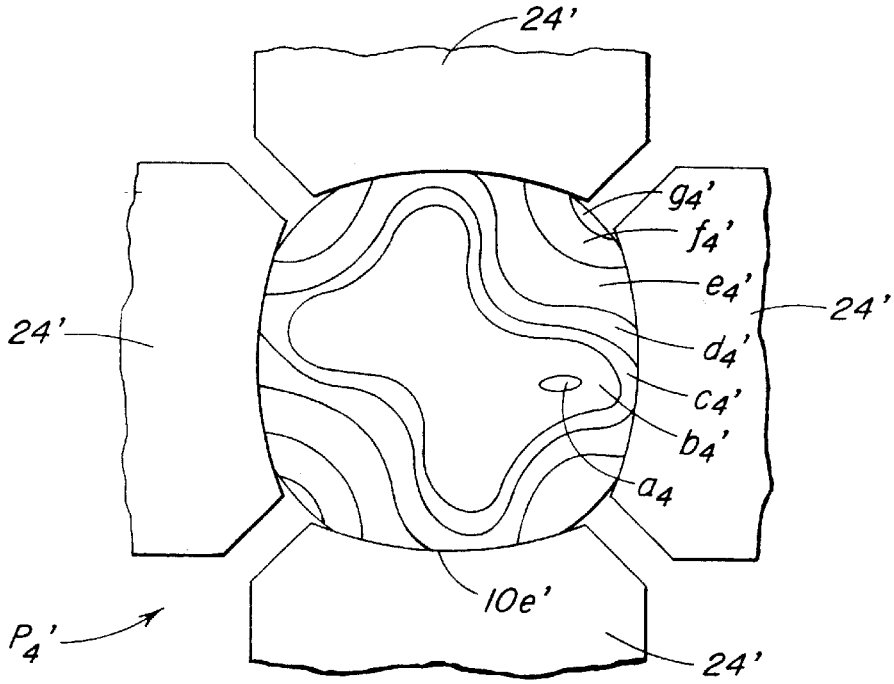

FIG. 3B shows that the same basic pattern persists in the finished product 10*e*' emerging from roll pass $P_{4'}$.

We claim:

1. A method of continuously rolling a ferrous workpiece into a finished round, comprising:

rolling said workpiece in an oval first roll pass and a round second roll pass at an elevated temperature of between about 650 to 1000° C., said first and second roll passes each being defined by two work rolls and being dimensioned to effect a combined reduction in the cross sectional area of said workpiece of at least about 20–55%, with an accompanying effective strain pattern dominated by a concentration of maximum effective strain at a central region of said cross sectional area; and while said effective strain pattern remains dominated by a concentration of maximum effective strain at a central region of said cross section, continuing to roll said workpiece in at least third and fourth consecutive round roll passes, each of said third and fourth roll passes being defined by at least three rolls and being sized to effect a combined reduction in the cross sectional area of said workpiece of not more than about 4–25%.

2. The method of claim 1 wherein rolling continues in said third and fourth roll passes prior to the occurrence of microstructural changes due to recrystalization and recovery.

3. The method of claim 1 or 2 wherein the workpiece emerges from the last of said at least third and fourth roll passes as a finished round having no more than ±0.1 mm diameter tolerance and 0.1 mm ovality.

4. The method of claim 1 wherein after cooling to a state of thermal equilibrium, said workpiece has a grain size variation across its cross section of not more than about 2 ASTM grain size numbers.

5. A method of continuously rolling a round ferrous workpiece, comprising:

rolling said workpiece in successive first and second roll passes at an elevated temperature of between about 650 to 1000° C., said first and second roll passes each being defined by two work rolls and being configured respectively to impart progressively reduced oval and round cross sections to said workpiece and to effect a combined reduction in the cross sectional area of said workpiece of at least about 20–55%, with an accompanying effective strain pattern dominated by a concentration of maximum effective strain at a central region of said cross sectional area; and prior to the occurrence of microstructural changes due to recrystalization and recovery, while said effective strain pattern remains dominated by a concentration of maximum effective strain at a central region of said cross section, continuing to roll said workpiece in at least third and fourth consecutive round roll passes into a finished round, each of said third and fourth roll passes being defined by at least three rolls and being sized to effect a combined reduction in the cross sectional area of said workpiece of not more than about 4–25%, with said finished round having no more than ±0.1 mm diameter tolerance and 0.01 mm ovality.

* * * * *